US008046854B2

(12) United States Patent
Lim et al.

(10) Patent No.: US 8,046,854 B2
(45) Date of Patent: Nov. 1, 2011

(54) WASHING MACHINE

(75) Inventors: Hee Tae Lim, Changwon-si (KR); Kyu Hwan Lee, Changwon-si (KR); Jae Hyun Choi, Changwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 12/183,558

(22) Filed: Jul. 31, 2008

(65) Prior Publication Data

US 2009/0139038 A1 Jun. 4, 2009

(30) Foreign Application Priority Data

Aug. 3, 2007 (KR) ..... 10-2007-0078071

(51) Int. Cl.
*D06F 35/00* (2006.01)
*D06F 39/02* (2006.01)

(52) U.S. Cl. ..... 8/149.3; 8/149.2; 8/158; 68/5 C; 68/5 R

(58) Field of Classification Search ..... 68/5 C, 68/5 R; 8/158, 159, 149.1, 149.2, 149.3
See application file for complete search history.

(56) References Cited

FOREIGN PATENT DOCUMENTS

| | | | |
|---|---|---|---|
| KR | 1020070075491 | * | 1/2006 |
| KR | 10-2007-0078584 A | | 8/2007 |
| WO | WO 2006101377 A1 | * | 9/2006 |

OTHER PUBLICATIONS

Machine Translation of Korean Patent Application No. KR 1020070075491 to Bae, Jan. 2006.*

* cited by examiner

*Primary Examiner* — Joseph L Perrin
*Assistant Examiner* — Benjamin Osterhout
(74) *Attorney, Agent, or Firm* — Birch, Stewart, Kolasch & Birch, LLP

(57) ABSTRACT

Disclosed is a washing machine, The washing machine includes a tub to contain washing water; a drum rotatably installed in the tub to contain laundry to be washed; a detergent box to contain a detergent supplied to the inside of the tub; and a steam generating device to heat water to generate steam, supply the generated steam to the drum, and supply the heated water selectively to the detergent box.

3 Claims, 3 Drawing Sheets

WASHING MACHINE

This application claims the benefit of Korean Patent Application No. 10-2008-0078071, filed on Aug. 03, 2007, which is hereby incorporated by reference as if fully set forth herein.

BACKGROUND OF THE INVENTION

1. Field of the Invention

The present invention relates to a washing machine, and more particularly, to a washing machine, which has an enhanced washing efficiency.

2. Discussion of the Related Art

Generally, in case that a washing machine is used, laundry is firstly put to the inside of the washing machine and then a laundry detergent and/or a functional detergent, such as a fabric softener, are put into a detergent box. Thereafter, when the washing machine is operated, water supplied to the inside of the washing machine flows into a drum by way of the detergent box. Specifically, the water supplied to the inside of the washing machine flows, together with the laundry detergent in the detergent box, into the drum. In this case, since a solid detergent is mainly used as the laundry detergent in the detergent box, the solid detergent is dissolved in water and then supplied to the drum.

In case that the washing machine is operated, cold water is supplied to the inside of the washing machine unless hot water is selected. Therefore, in case that cold water is supplied into the detergent box, the solid detergent in the detergent box is not easily dissolved in the cold water and thus remains in the detergent box. Thereby, a desired amount of the detergent is not supplied to the inside of the drum, and thus lowers the washing efficiency of the washing machine and further causes a user to remove the remaining detergent in the detergent box after the washing of the laundry has been completed.

SUMMARY OF THE INVENTION

Accordingly, the present invention is directed to a washing machine.

One object of the present invention is to provide a washing machine, which has an enhanced washing efficiency.

To achieve this object and other advantages and in accordance with the purpose of the invention, as embodied and broadly described herein, a washing machine includes a tub to contain washing water; a drum rotatably installed in the tub to contain laundry to be washed; a detergent box to contain a detergent supplied to the inside of the tub; and a steam generating device to heat water to generate steam, supply the generated steam to the drum, and supply the heated water selectively to the detergent box, The steam generating device may include a water supply unit to supply the heated water selectively to the detergent box.

The water supply unit may include a connection channel to supply the water heated by the steam generating device to the detergent box; and an opening unit to selectively open the connection channel.

The connection channel may be connected to a supply channel to supply water to the detergent box.

The steam generating device may further include a remaining water discharge hole to discharge remaining water; and the connection channel may be connected to the remaining water discharge hole.

The remaining water discharge hole may be provided at the lower portion of the steam generating device.

The opening unit may be opened for a designated time, after another designated time has elapsed from the beginning of the operation of the steam generating device by inputting an operating instruction to the washing machine.

In another aspect of the present invention, a method of controlling a washing machine with a steam generating device includes inputting an operating instruction to the washing machine; heating water in the steam generating device; supplying the water heated by the steam generating device to a tub of the washing machine together with a detergent; and performing washing of laundry.

In the supply of the water heated by the steam generating device to the tub, the water heated by the steam generating device may be supplied to a detergent box of the washing machine, and be then supplied to the tub of the washing machine together with the detergent in the detergent box and washing water.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
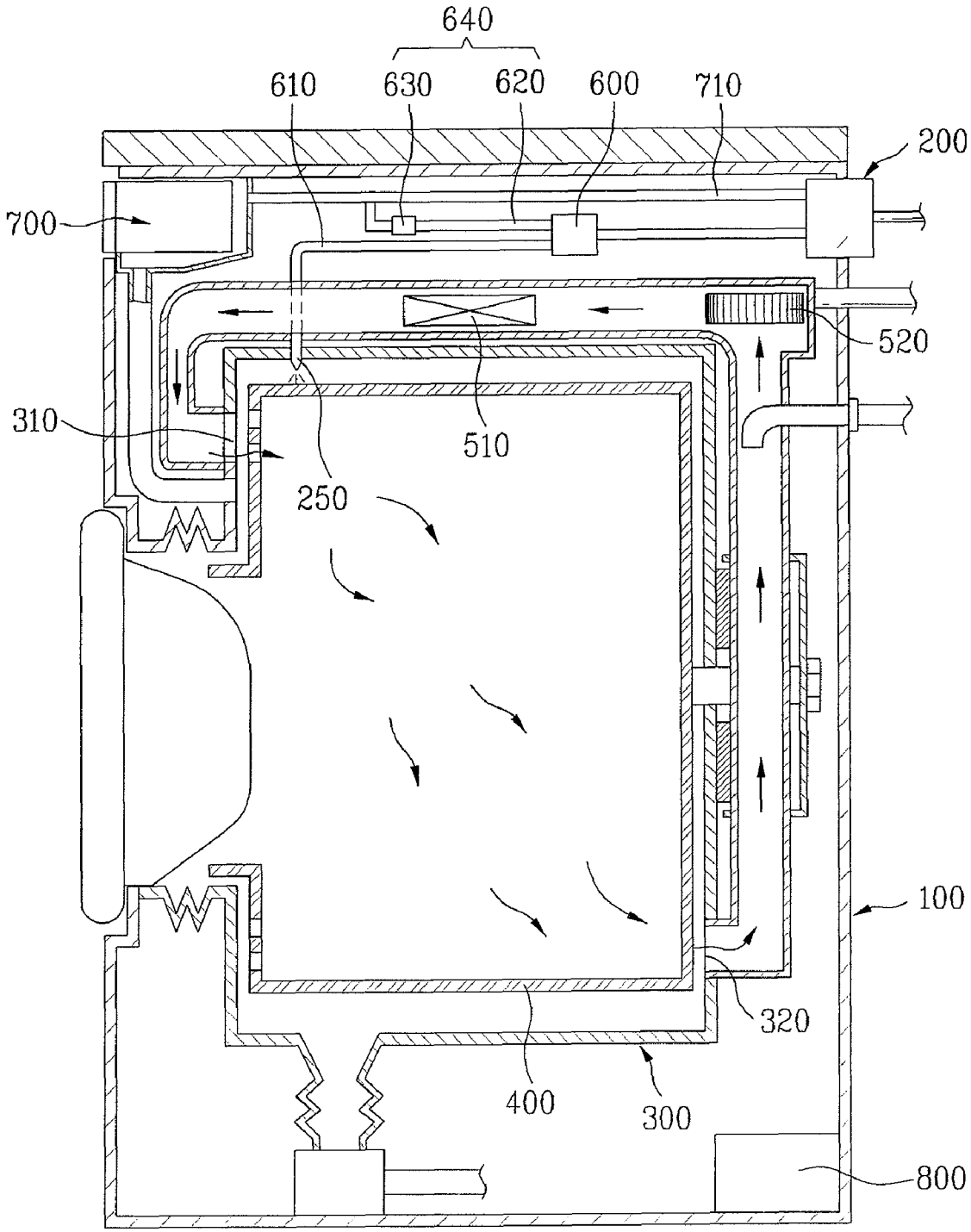
FIG. 1 is a cross-sectional view illustrating the constitution of a washing machine in accordance with a preferred embodiment of the present invention.

FIG. 1 is a cross-sectional view illustrating the internal constitution of a washing machine in accordance with a preferred embodiment of the present invention.

With reference to FIG. 1, the washing machine of this embodiment includes a cabinet 100 forming the external appearance of the washing machine, a tub 300 installed in the cabinet 100, a drum 400 rotatably installed in the tub 300, a detergent box 700 containing a detergent supplied to the inside of the drum 400, and a steam generating device 600 supplying steam to the drum 400 and including a water supply unit 640 selectively supplying heated water to the detergent box 700.

A water supply valve 200, which is connected to an external water pipe (not shown) and supplies water to the inside of the washing machine, is provided at one side of the cabinet 100. A portion of the water supplied through the water supply valve 200 is supplied to the detergent box 700 along a supply channel 710 and is then supplied to the inside of the tub 300 together with the detergent, and the remainder of the water is supplied to the steam generating device 600.

The steam generating device 600 of this embodiment not only heats supplied water and supplies generated steam to the inside of the drum 400, but also supplies the remainder of heated water to the detergent box 700 so as to prevent the leftover of the detergent in the detergent box 700.

Specifically, the steam generated by the steam generating device 600 flows along a steam discharge channel 610, and is supplied to the inside of the drum 400 through a nozzle 250. Further, the steam generating device 600 of this embodiment includes the water supply unit 640, which supplies the remainder of water to the detergent box 700. The water supply unit 640 supplies the remainder of the water heated by the steam generating device 600 to the detergent box 700 according to control of a control unit 800.

Here, the water supply unit 640 includes a connection channel 620 connecting the steam generating device 600 and the detergent box 700, and an opening unit 630 selectively opening the connection channel 620. The connection channel 620 connects the steam generating device 600 and the detergent box 700 to each other, and thus allows the remainder of the water heated by the steam generating device 600 to be supplied to the detergent box 700. In this case, the opening unit 630 to adjust the flow of the remaining heated water is preferably provided in the connection channel 620. The opening unit 630 is selectively opened according to the control of the control unit 800, and thus causes the remaining heated water to flow into the detergent box 700 along the connection channel 620.

Specifically, the control unit opens the opening unit 630 after a designated time has elapsed from the operation of the steam generating device 600, i.e., the beginning of the heating of water by the steam generating device 600, by the operation of the washing machine. That is, when the opening unit 630 is opened simultaneously with the beginning of the heating of water by the steam generating device 600, the water in the steam generating device 600 is supplied to the detergent box 700 and thus may be insufficient in generating steam. Further, when the opening unit 630 is opened simultaneously with the beginning of the heating of water by the steam generating device 600, the water in the steam generating device 600 is not sufficiently heated and then is supplied to the detergent box 700, and thus cannot sufficiently dissolve the detergent in the detergent box 700. Thus, in this embodiment, after a designated time enough to heat water in the steam generating device 600 and supply generated steam to the inside of the drum 400 has elapsed, the opening unit 630 is opened. The designated time is not limited specially, and for example, may be set to 3 to 5 minutes.

The opening unit 630 of the present invention may be a valve, but is not limited thereto. That is, the opening unit 630 may be properly modified into any device, which can selectively open and close the connection channel 620.

The connection channel 620 of the washing machine of the present invention is connected to the supply channel 710 connecting the water supply valve 200 and the detergent box 700. That is, the connection channel 620 is connected to the supply channel 710 connected to the detergent box 700, and thus the remaining water in the connection channel 620 flows into the detergent box 700 through the supply channel 710. Thereby, it is possible to prevent the deformation and the breakage of the detergent box 700, which is generally made of synthetic resin, due to the supply of the remaining water of a high temperature directly to the detergent box 700.

Although not shown in the drawings, the connection channel 620 extended from the steam generating device 600 may be connected directly to the detergent box 700. In this case, the detergent box 700 is preferably made of a heat resistant material, in preparation for the direct supply of the high-temperature remaining water.

A hot air inlet 310, through which air heated by a drying heater 510 is supplied to the inside of the tub 300, is formed at one side of the tub 300, and a hot air outlet 320, through which the air in the tub 300 is discharged to the outside of the tub 300, is formed at the other side of the tub 300. The air heated by the drying heater 510 flows along a drying duct 500 forming a channel connecting the hot air outlet 320 and the hot air inlet 310, and is supplied into the tub 300 and the drum 400 by an air blast fan 520 provided in the drying duct 500, thus being circulated.

Figure 2:
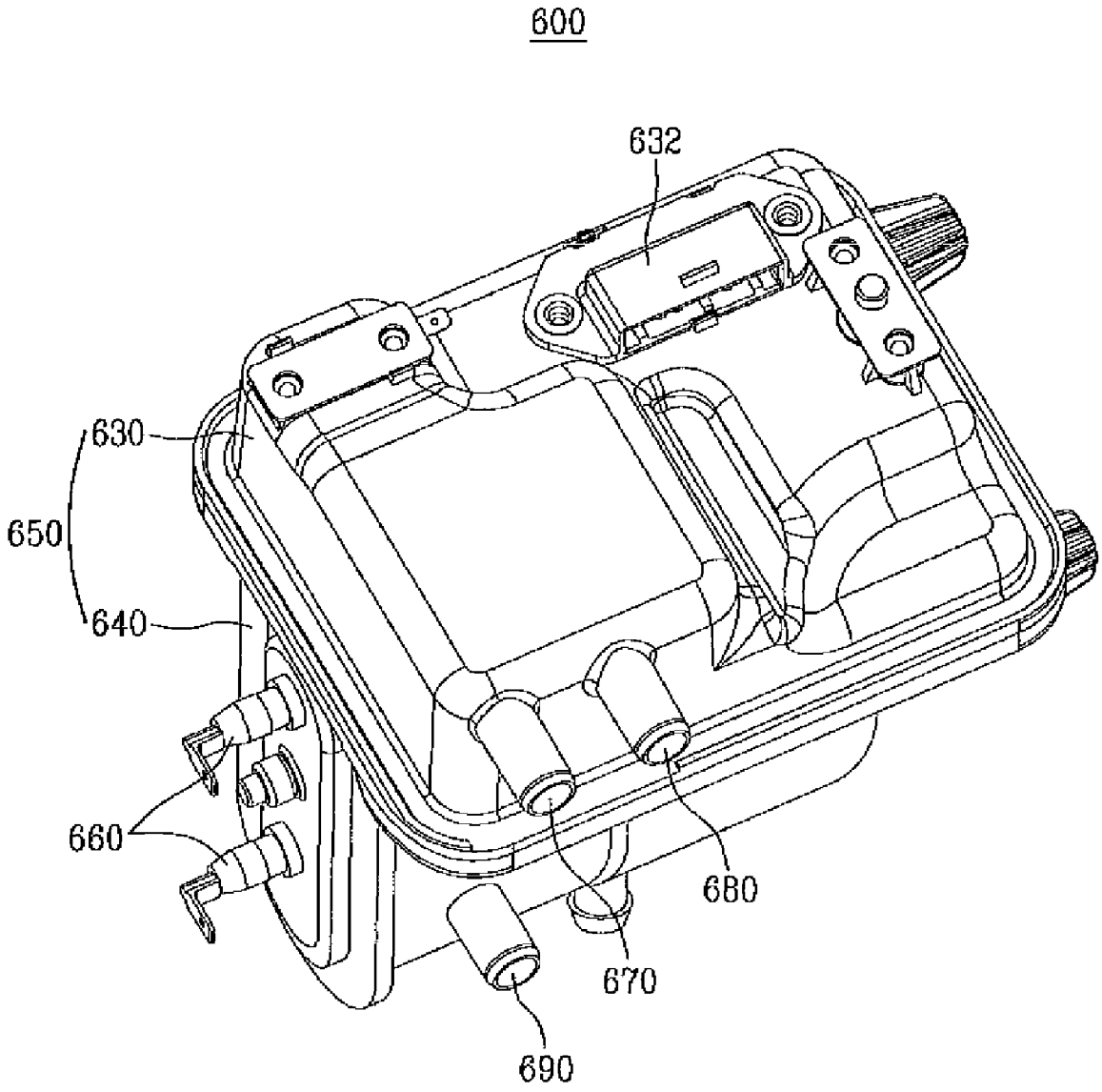
FIG. 2 is a perspective view illustrating a steam generating device of the washing machine of FIG. 1.

FIG. 2 is a perspective view illustrating the steam generating device 600 of the washing machine in accordance with the preferred embodiment of the present invention.

With reference to FIG. 2, the steam generating device 600 includes a housing 650 to contain water to be heated, and a heater 660 to heat the water in the housing 650 to generate steam.

The housing 650 forms the external appearance of the steam generating device 600, and includes an upper housing 630 and a lower housing 640, which form an adequate custody space therein to contain water supplied through a water supply hole 670. In this case, an external water supply source, such as a tap, or a detachable cartridge-type water supply source may be employed as a water supply source.

A water level sensor 632 to sense the level of water in the housing 650 is provided at one side of the housing 650. The water level sensor 632 senses the level of water, which is supplied to the inside of the housing 650. Thus, when a proper amount of water is supplied to the inside of the housing 650, the control unit 800 stops the supply of water according to the level of the water measured by the water level sensor 632.

The steam generating device 600 further includes a remaining water discharge hole 690 to discharge remaining water, in case that the remaining water is generated. Preferably, the remaining water discharge hole 690 is located at the lower portion of the housing 650. The reason is that the remaining water is located in the lower portion of the housing 650. Thus, one end of the connection channel 620 (with reference to FIG. 1) to supply the remaining water from the steam generating device 600 to the detergent box 700 (with reference to FIG. 1) is preferably connected to the remaining water discharge hole 690.

When the remaining water of the steam generating device 600 is supplied to the detergent box 700, as described above, it is expected that all amount of the detergent in the detergent box 700 would be supplied to the drum 400 and foreign substances in the steam generating device 600 would be removed. That is, in case that the hardness of water supplied to the steam generating device 600 is high, a calcareous substance is produced due to calcium ions, magnesium ions, etc., contained in the water. The calcareous substance, which is attached to the inside of the steam generating device 600, lowers the heating efficiency of the steam generating device 600 and closes a steam discharge hole 680 of the steam generating device 600. Therefore, the steam generating device 600 of the present invention discharges the remaining heated water to the detergent box 700, and thus prevents the generation of foreign substances, such as a calcareous substance, in the steam generating device 600.

Figure 3:
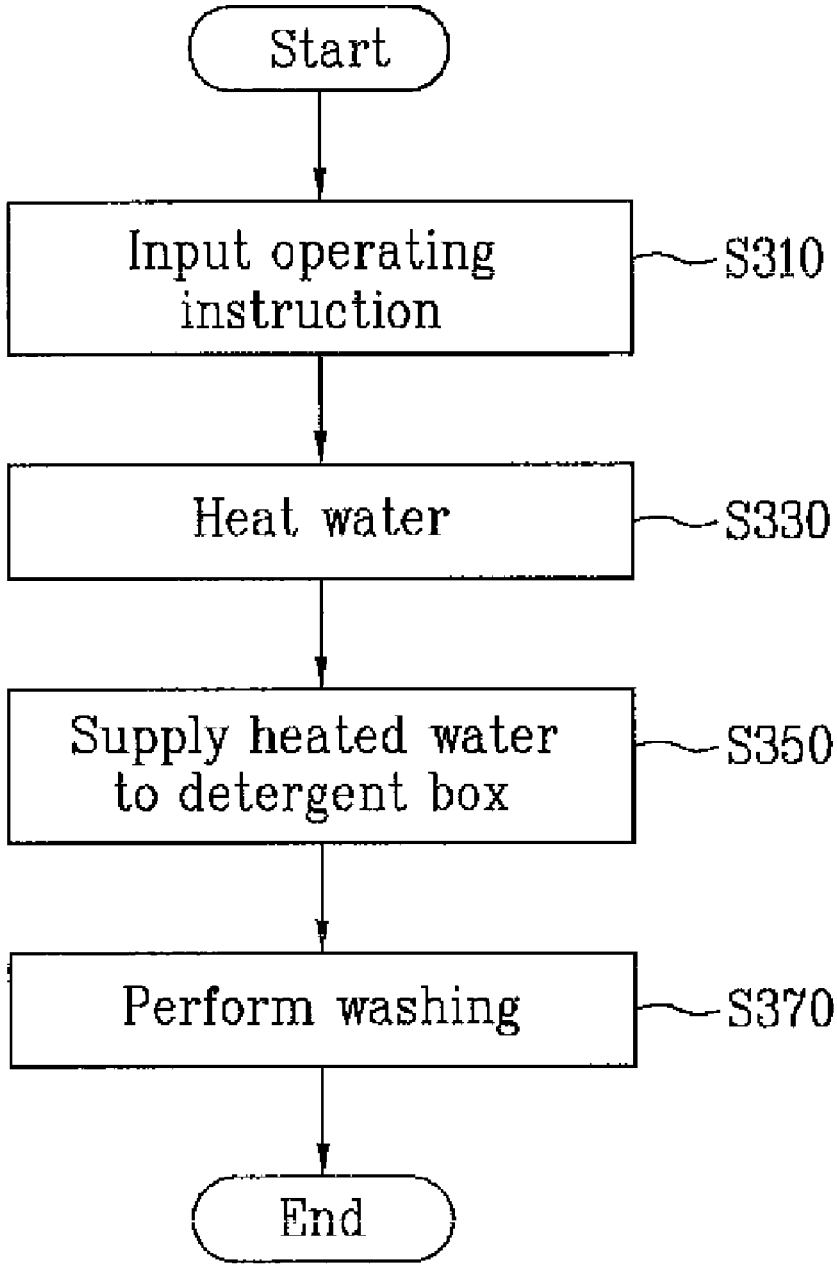
FIG. 3 is a flow chart illustrating a method of controlling the washing machine of FIG. 1.

Hereinafter, an operation of the above washing machine will be described with reference to FIG. 3. FIG. 3 is a flow chart illustrating a method of controlling the washing machine of FIG. 1.

First, a user puts laundry to be washed into the drum 400 of the washing machine, and inputs an operating instruction (S310).

Thereafter, the steam generating device 300 heats water supplied therein, and thus generates steam (S330). The steam generated by the steam generating device 300 is supplied to the drum 400, and thus sterilizes the laundry or allows the laundry to be easily soaked in water.

After a designated time has elapsed, the remainder of the water heated by the steam generating device 600 together with the detergent is supplied to the tub 300 of the washing machine (S350). Specifically, the water heated by the steam generating device 600 is supplied to the detergent box 700 of the washing machine, and is then supplied to the tub 300 of the washing machine together with the detergent and washing water supplied to the detergent box 700. That is, since the remaining heated water is supplied to the detergent box 700, it is possible to supply all amount of the detergent in the detergent box 700 to the drum 400.

After all amount of the detergent has been supplied to the drum 400, washing of the laundry is performed (S370).

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of controlling a washing machine with a steam generating device, comprising:

inputting an operating instruction into a control unit of the washing machine;

heating water to generate steam in the steam generating device;

supplying the steam to a drum of the washing machine;

supplying the heated water selectively by the steam generating device to a detergent box for a designated time based on the operating instruction of the control unit, after another designated time has elapsed from the beginning of the operation of the steam generating device; and performing washing of laundry.

2. The method according to claim 1, wherein the water heated by the steam generating device supplied to the detergent box is then supplied to the tub together with the detergent in the detergent box and washing water.

3. The method according to claim 1, wherein the washing machine further comprises a connection channel to supply the water heated by the steam generating device to the detergent box and an opening unit to selectively open the connection channel, and in the supplying the heated water to the detergent box, the opening unit is opened to supply the heated water to the detergent box after another designated time has elapsed from the beginning of the operation of the steam generating device.

* * * * *